United States Patent [19]

Evans

[11] 4,294,020

[45] Oct. 13, 1981

[54] PLENUM DRYING HOPPER WITH INTEGRAL HEATERS

[75] Inventor: Arthur J. Evans, Northville, Mich.

[73] Assignee: Whitlock, Inc., Farmington, Mich.

[21] Appl. No.: 148,517

[22] Filed: May 9, 1980

[51] Int. Cl.[3] ..... F26B 17/14

[52] U.S. Cl. ..... 34/168; 34/169; 34/226

[58] Field of Search ..... 34/168, 169, 174, 226, 34/231; 219/374, 381

[56] References Cited

U.S. PATENT DOCUMENTS

| | | | |
|---|---|---|---|
| 2,901,837 | 9/1959 | Niems | 34/174 |
| 3,365,813 | 1/1968 | Collins et al. | 34/174 |
| 3,875,683 | 4/1975 | Waters | 34/169 |

*Primary Examiner*—Larry I. Schwartz

*Attorney, Agent, or Firm*—Kinzer, Plyer, Dorn & McEachran

[57] ABSTRACT

A plenum drying hopper for granular material includes a housing enclosing a plenum chamber, an upper material inlet for introducing a flow of granular material into the plenum chamber, and a perforate diffuser cone, located in the lower portion of the plenum chamber, that directs the granular material from the plenum chamber into a material outlet. The perforations in the diffuser cone are large enough to permit ready passage of gas therethrough but small enough to preclude passage of all but the finest particles of the granular material. A gas inlet extends into the lower portion of the housing for introducing a drying gas (air) into the plenum chamber; a gas outlet discharges the gas from the upper part of the housing. Heaters are provided for heating the gas prior to its entry into the plenum chamber. The improvement comprises a deflection shield structure mounted in the housing below the plenum chamber between the heaters and the diffuser cone, that directs heated air along a labyrinthine path from the heaters through the diffuser cone and into the plenum chamber. It also shields the diffuser cone from the heaters to prevent radiant heat from reaching the diffuser cone, and deflects fine particles of the granular material that pass through the diffuser cone directly into the material outlet.

4 Claims, 2 Drawing Figures

PLENUM DRYING HOPPER WITH INTEGRAL HEATERS

BACKGROUND OF THE INVENTION

This invention relates to plenum drying hoppers for granular resin materials used in plastic molding and similar processing. More particularly, the invention concerns a plenum drying hopper which uses relatively high temperature heaters in the hopper itself in a construction that precludes melting of the granular material, especially fine particles of that material.

The need for higher operating temperatures in plenum drying hoppers has long been recognized, but problems have existed due to melting of the granular plastic materials, especially the fine particles or dust from these materials, when high temperature heaters are used. For other granular materials, radiant heat from high-temperature heaters may damage the material without actual melting. Another problem has existed in that fine particles which pass through the diffuser screen may fall on the heaters and must be cleaned out from the bottom of the hopper. Any fine particles or dust that falls on the heaters is likely to melt and hence is not easily removable, creating a difficult clean-up problem.

SUMMARY OF THE INVENTION

It is an object of the invention, therefore, to provide a new and improved plenum drying hopper for granular material, using high temperature heaters located within the hopper, that effectively precludes any melting or other damage to the granular material from radiant heat produced by the heaters.

Another object of the invention is to provide a new and improved plenum drying hopper for granular material that effectively precludes loss of fine material through the diffuser cone employed to introduce a drying gas (air) into the plenum chamber of the hopper, returning the fine material to the outlet of the hopper.

Accordingly, the invention relates to a plenum drying hopper for reducing the moisture content of granular material that includes a housing enclosing a plenum chamber. The plenum chamber has an upper material inlet for introducing a flow of granular material into the plenum chamber, a lower material outlet for discharging the granular material from the plenum chamber, and a perforate diffuser cone at the bottom of the plenum chamber for directing the flow of granular material from the plenum chamber into the material outlet. The perforations in the diffuser cone are large enough to permit ready passage of gas therethrough yet are small enough to preclude the passage of all but the finest particles of the granular material. A gas inlet extends into the housing, below the diffuser cone, for introducing dry gas into the plenum chamber. A gas outlet extends from the upper portion of the housing for discharging gas from the housing after contact with the granular material flowing through the plenum chamber. A separator barrier is positioned between the gas inlet and the diffuser cone, and a plurality of heaters are mounted in gas passages extending through that barrier to heat gas flowing from the gas inlet through those passages toward the diffuser cone. Deflection shield means are located in the lower portion of the housing, between the heaters and the diffuser cone. The deflection shield means directs heated gas along a labyrinthine path from the heaters into the plenum chamber through the diffuser cone while shielding the diffuser cone from the heaters to prevent radiant heat from reaching the diffuser cone; the shield also deflects any fine particles of the granular material that passed through the diffuser cone to the material outlet.

DETAILED DESCRIPTION OF THE INVENTION

Figures 1, 2:
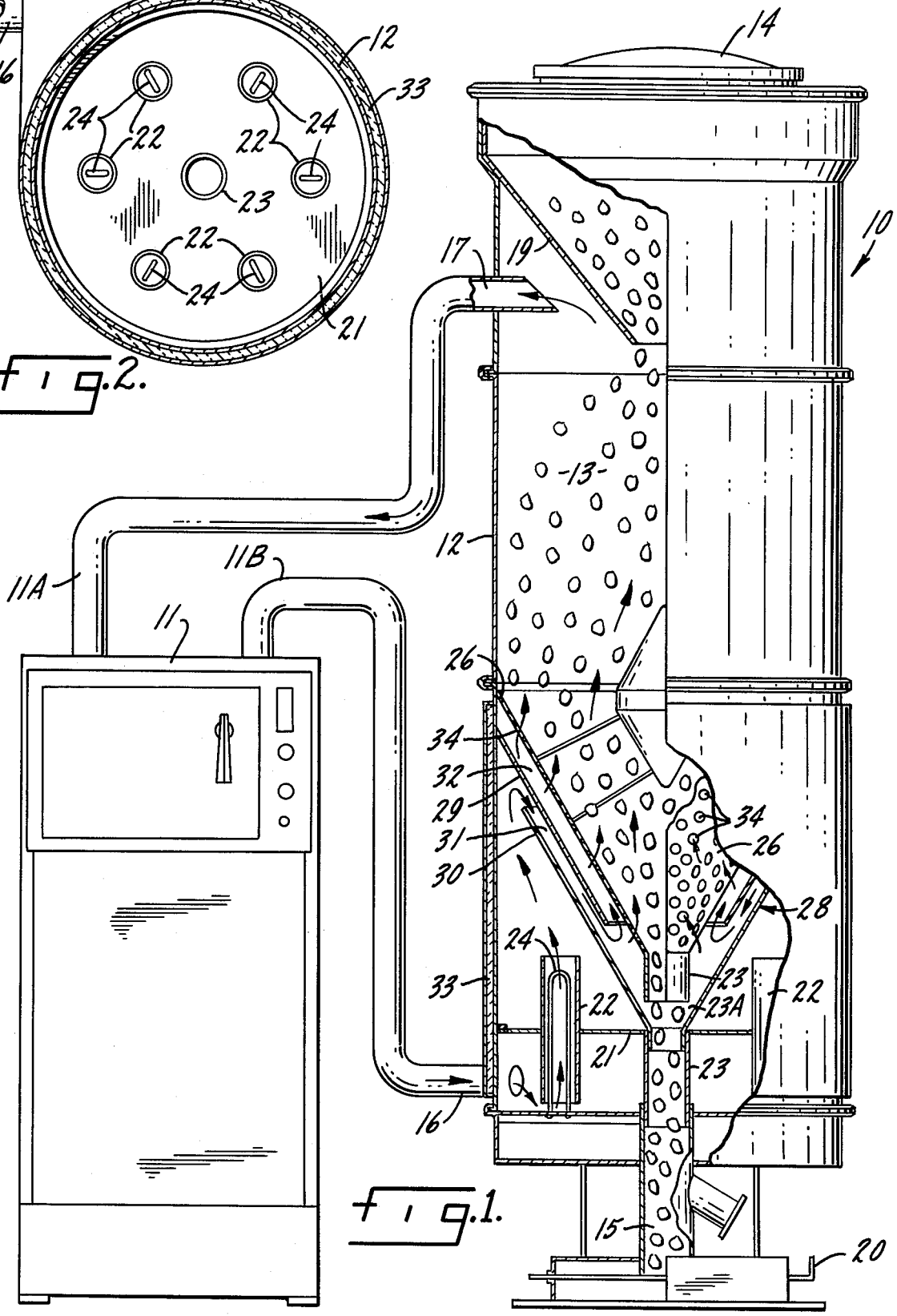
FIG. 1 is an elevation view, with parts broken away and partially in cross section, of a plenum drying hopper constructed in accordance with a preferred embodiment of the invention.
FIG. 2 is a plan view of the heater elements and separator plate of the plenum drying hopper of FIG. 1.

FIG. 1 shows a plenum drying hopper 10 connected to a dehumidifying dryer 11. Dehumidifier dryer 11 may be of any conventional type which will reduce the moisture content of a gas, usually air, which is introduced into dryer 11 through an inlet 11A, producing a drier gas at the outlet 11B. The dry gas may be warmed or pre-heated as desired.

Plenum drying hopper 10 is made up of a housing 12 enclosing a plenum chamber 13. An insulator jacket 33 may encompass part or all of housing 12. An upper material inlet 14 and a lower material outlet 15 allow introduction and withdrawal of granular resin material from the plenum chamber 13. A gas inlet passage 16 extends into the plenum chamber 13 and introduces a dry gas from the dehumidifying dryer 11 into plenum chamber 13. A gas outlet 17 is spaced from the gas inlet passage 16 and discharges gas from plenum chamber 13 after the gas has passed through the granular material within the plenum chamber.

In the drawings, the material inlet 14 is shown as a vacuum loader cover. However, the material inlet means could be of any other conventional type, such as a manual loader cover. The material to be dried is introduced into the plenum chamber 13 through material inlet 14. An air trap cone 19 allows the material to pass downwardly and fill the chamber but does not allow gas to escape through the material inlet 14. The material outlet 15 includes a slide gate 20 which is closed when there is material in the hopper and is open to allow the material to exit the chamber for use in an extrusion molding press or other processing equipment with which hopper 10 is employed. Thus, the entire plenum chamber 13 is filled with the granular material to be dried. As resin material is withdrawn through the outlet 15, additional material is added through the inlet 14, thus maintaining a full plenum chamber 13.

A separator plate 21 is located in the housing 12 between the gas inlet passage 16 and the plenum chamber 13. The separator plate is pierced only by a series of tubular gas passages 22 which extend a considerable distance above and below the separator plate and by a material passage 23 leading from chamber 13 to the lower material outlet 15. The material passage 23 is centrally located in the separator plate 21 and the tubular passages 22, in this case six in number, are located in a circle surrounding the material passage as shown in FIG. 2. A looped electrical resistance heater 24 is installed in each tubular passage to heat the dried air which enters the housing 12 through the gas inlet passage 16.

In the plenum drying hopper 10, the drying air or other drying gas flows upwardly through the tubular heating passages 22 and into an air diffuser cone 26. The cone 26 is made of a material having a multiplicity of small openings 34 which allows the gas to diffuse into the plenum chamber but do not allow the bulk of the granular resin material to pass through the cone. However, a limited quantity of fine particles or dust from the granular plastic material is likely to pass through the openings in the diffuser cone 26.

To prevent these fine particles or dust from reaching the electrical resistance heaters 24, a deflection shield means 28 is installed between the diffuser cone 26 and the tubular passages 22. The deflector shield means includes an upper imperforate member 29 of truncated conical configuration which extends from the housing 12 downwardly and inwardly toward the central material passage 23, and a lower imperforate member 30, again of conical configuration, positioned below member 29. This construction defines a passage 31 between the two conical members 29 and 30. A similar passage 32 separates member 29 and the diffuser cone 26.

The lower end of the conical member 30 is mounted on and sealed to the exterior of the material passage 23. A portion 23A of the material conduit 23 is open to the passage 32. Thus, any fine granulated material or dust which passes through the diffuser cone 26 is directed to the discharge outlet 15 through the inter-cone passage 32 and the discharge passage 23 and does not come in contact with the heater elements 24. The positioning of the conical members 29 and 30 provides a labyrinthine-like passage 31, 32 which draws heated air from the heaters 24 in a downwardly direction through the passage 31 and then in an upwardly direction into the passage 32 and through the diffuser cone 26 as shown by the arrows in FIG. 1.

The deflection shield means 28 performs two functions. The first is to prevent radiant heat from the resistance heaters 24 from impinging directly upon the granular plastic material in the plenum chamber 13. This precludes melting or other damage to the material being dried. The second function of shield means 28 is to prevent any of the dust or finely granulated plastic material from coming into contact with the high temperature electric resistance heaters 24, which would bring about melting of the plastic dust. Further, the shield means 28 deflects all dust directly into the outlet material passage 23, through the open portion 23A, and thus to the lower material outlet 15 where it becomes a part of the dried material discharged from the plenum drying hopper 10.

I claim:

1. A plenum drying hopper for reducing the moisture content of granular material, comprising:

a housing enclosing a plenum chamber and including an upper material inlet for introducing a flow of granular material into the plenum chamber and a lower material outlet for discharging the granular material from the plenum chamber;

a perforate diffuser cone, at the bottom of the plenum chamber, for directing the flow of granular material from the plenum chamber into the material outlet, the perforations in the diffuser cone being large enough to permit ready passage of gas therethrough and small enough to preclude passage of all but the finest particles of the granular material;

a gas inlet, extending into the housing below the diffuser cone, for introducing dry gas into the plenum chamber through the diffuser cone;

a gas outlet, extending from the upper portion of the housing, for discharging gas from the housing after contact with the granular material flowing through the plenum chamber;

a separator barrier positioned between the gas inlet and the diffuser cone;

a plurality of gas passages extending through the separator barrier;

a plurality of heaters, one in each gas passage, for heating gas flowing from the gas inlet through such passages toward the diffuser cone; and deflection shield means, mounted in the lower portion of the housing, between the heaters and the diffuser cone, for deflecting heated gas along a labyrinthine path from the heaters into the plenum chamber through the diffuser cone, shielding the diffuser cone from the heaters to prevent radiant heat from reaching the diffuser cone and deflecting any fine particles of the granular material that pass through the diffuser cone into the material outlet.

2. A plenum drying hopper according to claim 1 in which the deflector means comprises two imperforate conical shield members which converge toward the lower material outlet, the two shield members being spaced apart to provide a portion of the labyrinthine path for the heated gas.

3. A plenum drying hopper according to claim 1 or claim 2 in which each gas passage through the separator barrier comprises a tube enclosing one of the heaters.

4. A plenum drying hopper according to claim 3 in which each heater is an electrical resistance heater.

* * * * *